United States Patent [19]

Genini

[11] 4,235,261

[45] Nov. 25, 1980

[54] PAIR OF GRIPPERS FOR WEAVING LOOMS WITHOUT SHUTTLE

[75] Inventor: Graziano Genini, Stabio-Via Gaggiolo, Switzerland

[73] Assignee: Albatex A.G., Vaduz, Liechtenstein

[21] Appl. No.: 913,071

[22] Filed: Jun. 6, 1978

[30] Foreign Application Priority Data

Jun. 9, 1977 [CH] Switzerland ..... 7102/77

[51] Int. Cl.[2] ..... D03D 47/20

[52] U.S. Cl. ..... 139/448

[58] Field of Search ..... 139/446, 447, 448

[56] References Cited

U.S. PATENT DOCUMENTS

| | | | |
|---|---|---|---|
| 2,072,161 | 3/1937 | Dewas | 139/448 |
| 2,116,620 | 5/1938 | Dewas | 139/448 |
| 3,159,186 | 12/1964 | Juillard | 139/446 |
| 3,580,291 | 5/1971 | Piccoli | 139/448 |
| 3,717,182 | 2/1973 | Sparling | 139/446 |
| 4,040,454 | 8/1977 | Genini | 139/448 |

*Primary Examiner*—Henry Jaudon

*Attorney, Agent, or Firm*—Young & Thompson

[57] ABSTRACT

A pair of grippers for shuttleless loams without shuttle, of the type wherein a first gripper (carrying) grasps the weft thread at one side of the loom and carries it to the center of the warp shed, while the second gripper (drawing) receives the weft thread at the center of the warp shed from the carrying gripper, and transports it to the opposite side of the loom, where it releases the same. The weft thread grasping and holding members mounted on head parts of the grippers disposed on opposite sides of a sliding plane. Along said sliding plane said head parts move side by side, cooperating between them for grasping and releasing the weft thread.

1 Claim, 12 Drawing Figures

P
2
20
5
6
4
f
3
15
14
1
V
α

P
8
2
1
7

23
2
20
9
α
6
4
5
13
3
12
f
1
P
15
14

PAIR OF GRIPPERS FOR WEAVING LOOMS WITHOUT SHUTTLE

BACKGROUND OF THE INVENTION

The present invention relates to important improvements in the weft transport grippers for shuttleless looms, of the type wherein a first gripper (carrying) grasps the weft thread at one side of the loom and carries it to the centre of the warp shed, while the second gripper (drawing) receives the weft thread at the centre of the warp shed from the carrying gripper, and transports it to the opposite side of the loom, where it releases the same.

The pair of grippers according to the invention comprises grippers of reduced weight and dimensions which cooperate with each other without penetrating one into the other and which may move along a common plane, which may be differently oriented in respect of the plane of the loom reed.

SUMMARY OF THE INVENTION

The improved pair of weft transport grippers according to the invention is essentially characterized in that, in both grippers, the weft thread grasping and holding members are mounted on head parts of the grippers disposed on opposite sides of a sliding plane, along which said head parts move side by side, cooperating between them for grasping and releasing the weft thread. Said sliding plane may be parallel, perpendicular or differently inclined in respect of the plane of the loom reed.

The carrying gripper of the pair of grippers according to the invention is characterized by a rear part, whose side close to the sliding plane projects beyond said plane in respect of the head part of the gripper, so as to form a guide for the weft thread parallel to the plane itself, said head part comprising a pair of pegs for positioning the end of the weft thread, said pegs being arranged close to the free end of the thread grasping and holding means, on one side and on the other thereof, and in a position such as to cause the weft thread to be positioned between said guide and the first of said pegs only slightly inclined (about 25° at the most) in respect of the sliding plane.

Moreover, said carrying gripper mainly comprises a basic gripper body, the rear part of which is fixed to the gripper advancement strap and forms said guide for the weft thread, and the head part of which is equipped with said weft thread grasping and holding means, and a adapted to be applied on said basic body and comprising an opening for housing said weft thread grasping and holding means, said pegs projecting from said cover and fitting into said basic body or viceversa.

The drawing gripper of the same pair of grippers is also characterized by the fact that the thread guard of its head part comprises a profiled appendix, extending parallel to the gripper body for covering the weft thread grasping and holding means.

The invention also comprises shuttleless weaving looms using the aforespecified grippers.

DESCRIPTION OF THE PREFERRED EMBODIMENTS

Figure 1:
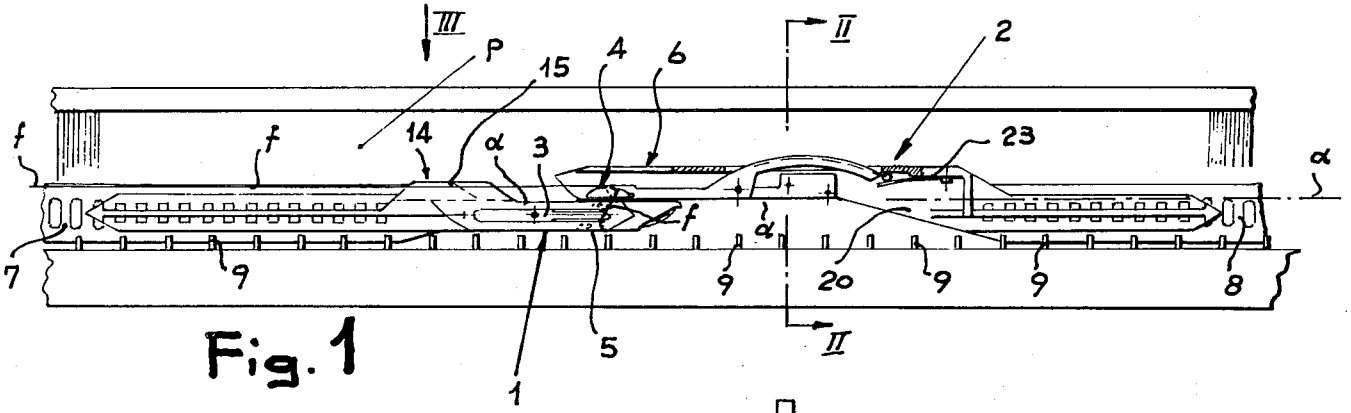
FIG. 1 is a front view of a loom part corresponding to the warp shed, showing a first type of a pair of weft thread transport grippers according to the invention, in a thread exchange position.

As shown in the drawings, the pair of grippers according to the invention comprises a carrying gripper 1 and a drawing gripper 2, in which the weft thread grasping and holding means 3 and 4 are mounted on head parts 5 and 6 of the grippers themselves which are arranged on one side and, respectively, on the other side of a plane $\alpha$ along which the gripper head parts 5 and 6 slide on each other in their working motion, cooperating between them with the mutually sliding parts of each disposed only on one side of that plane for exchanging the weft thread f.

Figure 2:
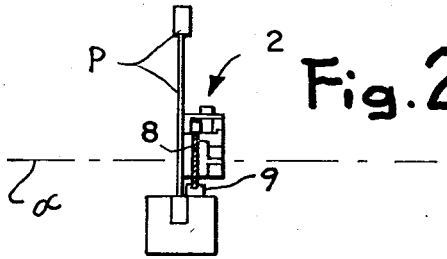
FIG. 2 is a section along the line II—II of FIG. 1.
Figure 3:
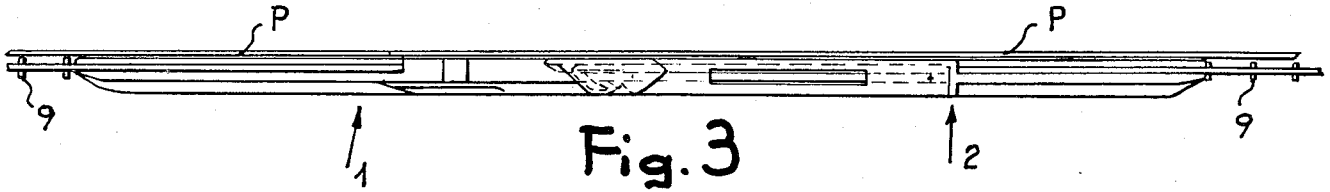
FIG. 3 is a top view according to the arrow III of the arrangement of FIG. 1.

In the arrangement of FIGS. 1 to 3, the plane $\alpha$ is perpendicular to the plane of the reed P, parallel to which are arranged the gripper advancement straps or tapes 7 and 8, sliding in special guiding supports 9, and the grippers themselves.

Figure 4:
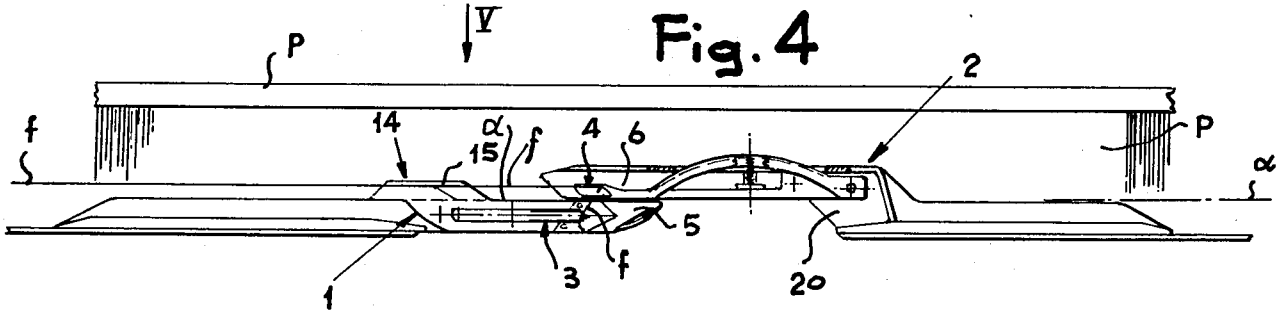
FIG. 4 is a view similar to that of FIG. 1, but showing a modified embodiment of the pair of grippers according to the invention on the loom, in the position of weft thread exchange.
Figure 5:
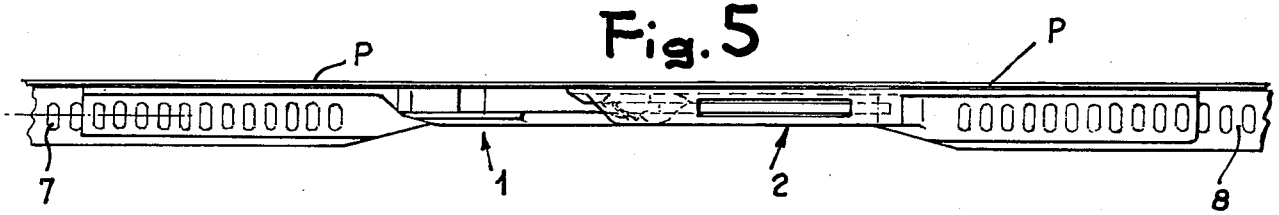
FIG. 5 is a top view according to the arrow V of the arrangement of FIG. 4.

In the arrangement of FIGS. 4 and 5, the plane $\alpha$ and the grippers are again arranged as in FIGS. 1 to 3, while their advancement straps are arranged along a plane parallel to the plane $\alpha$ and move along the same.

Figure 6:
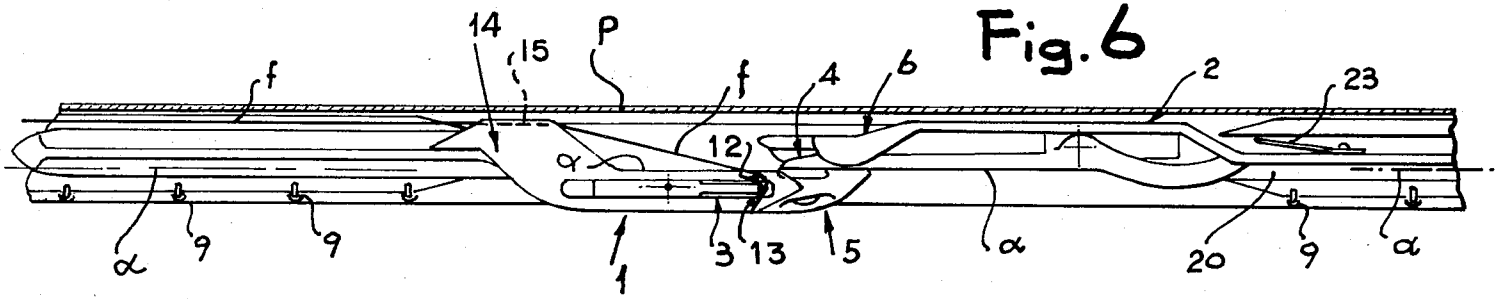
FIG. 6 is a top view of a third embodiment of the pair of grippers according to the invention in a condition which slightly precedes the weft thread exchange between the two grippers.
Figures 7, 8, 9, 10, 11, 12:
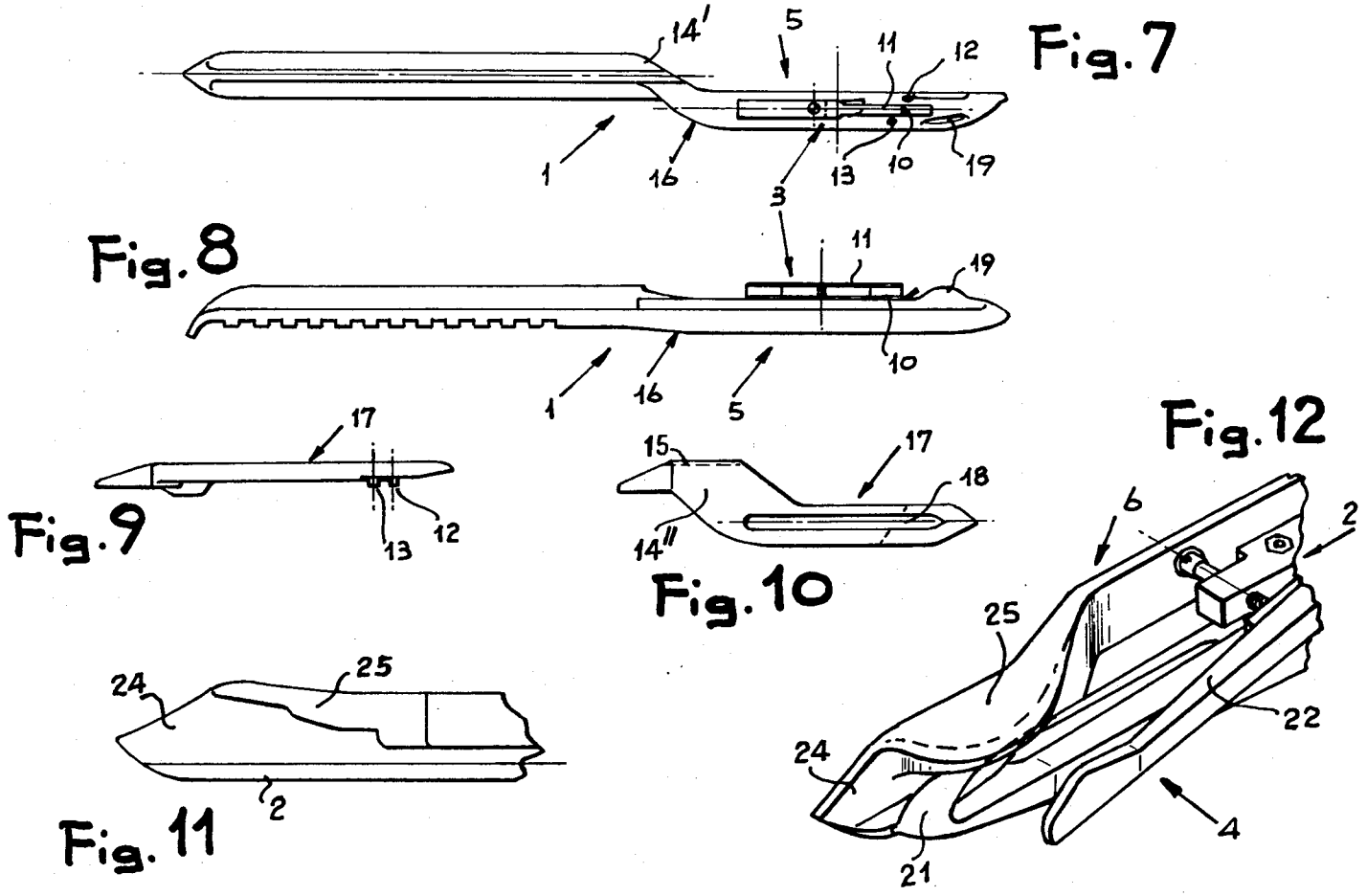
FIG. 7 is a front view of the body part of the carrying gripper, with the cover removed.
FIG. 8 is a bottom plan view of FIG. 7.
FIG. 9 is a bottom plan view of the removed cover of the carrying gripper.
FIG. 10 is a front view of the removed cover of the carrying gripper.
FIGS. 11 and 12 are a schematic side view and a fragmentary perspective view of the head part of the drawing gripper, illustrating the appendix for protecting the thread guard of said gripper.

In the arrangement of FIG. 6, the plane $\alpha$ is parallel to the plane of the reed P and the grippers and straps are arranged, more traditionally, perpendicular to said reed plane and parallel to the top plane of the sley (as well as perpendicular to the plane $\alpha$).

Although not shown, other arrangements of the grippers and straps could be provided, with the plane $\alpha$ lying inclined to different extents in respect of the plane of the reed and of the plane of the sley.

The carrying gripper of the pair of grippers according to the invention (FIGS. 1 to 10) comprises a head part 5, in which are mounted the weft thread grasping and holding members 3, consisting of a longitudinal elastic lamina 10, pressed by a leaf spring 11, which may for example correspond to those of U.S. Pat. No. 3,580,291 and of a pair of pegs 12 and 13, arranged close to the point of said elastic lamina, on one side and on the other thereof. The head comprises moreover a rear part 14, whose side close to the sliding plane $\alpha$ projects beyond said plane.

The carrying head 5 is formed (FIGS. 7 to 10) by two elements of plastic material associated with each other: a basic head body 16, the rear part of which 14' is fixed to the advancement strap 7, and the head part of which is equipped with the elastic lamina 10, for grasping and holding the weft thread, and with the associated leaf spring 11; and a cover 17, applied to the basic body 16 and comprising an opening 18 for the lamina 10 and related leaf spring 11. The rear part 14 of the cover 17 has its side close to the sliding plane $\alpha$ projecting beyond said plane and beyond the corresponding side of the rear part 14' of the underlying basic gripper body 16. On said cover side is formed a hollow guide 15 for the weft thread, which is parallel to and spaced away from the plane $\alpha$. The pegs 12 and 13 are carried by the cover 17, being fitted into the assembly in appropriate seats in the body 16 (of course, it could also be vice-versa). The removed cover 17 is separately shown in FIGS. 9 and 10, which latter figure shows the cover in the same position as in FIG. 6.

The head part 5 of the carrying gripper 1 further comprises a top fin 19, emerging perpendicular from the end of the body 16 which is not covered by the cover 17, with the function of protecting the warp yarns by preventing the weft thread grasping members from hitting the same. It is moreover appropriate to create in the gripper body 16 a hardened zone cooperating with the elastic lamina 10, for example by applying to said body a hard metal element, or in some other way.

The drawing gripper 2 according to the invention has its head part 6 (FIGS. 11 and 12) shifted sideways in respect of the rear part 20 connected to the advancement strap 8. On the head part 6 of the gripper are arranged (FIGS. 11 and 12) weft thread grasping and holding means 4, of the type described in U.S. Pat. No. 4,040,454. The gripper 2 draws the weft thread from the gripper 1 when—as in FIGS. 1 to 6—these two members meet and their heads 5 and 6 come up side by side on a single side. Such means comprise a fixed hook 21 and an oscillating lever 22, whose head wedges into the hook 21 so as to lock therein the weft thread under the action of spring means 23 (FIGS. 1 to 6). According to the invention, the head part 6 of gripper 2 is provided (FIGS. 11 and 12) with a thread guard 24 comprising a profiled appendix 25 extending substantially parallel to the gripper 2 for covering the hook 21.

With the pair of grippers heretofore described and illustrated, the weft thread f will lie in the guide 15 of head part 5, in alignment with its feeding path and very slightly inclined (no more than 25°) in respect of this alignment (and thus in respect of the sliding plane $\alpha$ between the heads of the grippers) in the area between the guide 15 and the peg 12 of the head 5 of the gripper 1, namely in the area in which the weft thread is grasped by the grasping elements 4 of gripper 2. Between the peg 12 and the peg 13, the weft thread f is instead arranged to extend between these pegs, being engaged by the elastic lamina 11.

The arrangement according to the invention introduces the use of light and slender grippers (particulary remarkable in the case of the carrying gripper, up to date always very bulky), which exchange the weft at the centre of the warp shed by simply coming close to each other with their head parts, on one side only, with evident progress and advantage compared to the known technique of inserting the whole head of the drawing gripper into an appropriate housing of the carrying gripper.

In fact, the surfaces of the two grippers coming into contact at the moment of thread exchange are reduced to a third, or even to a fourth, thereby preventing or highly reducing impacts, frictions, possible jamming and failed grasping of the weft thread.

A further remarkable improvement and advantage is obtained, according to the invention, thanks to the arrangement of the weft thread, which is slightly inclined in respect of its feeding alignment, in the gripping area between the guide 15 and the peg 12 of the head 5 of the carrying gripper 1. Thanks to this arrangement, the weft thread is not subjected, at the moment of exchange, to the traditional front impact (substantially at 90° over a very short thread length) by the hook of the drawing gripper; on the contrary, the engagement takes place very smoothly, progressively and over a very long thread length; this helps to prevent, or at least to highly reduce cases of tears, abrasions and weakening of the weft thread, in general, which compromise the proper outcome of the thread exchange. This latter may be carried out with a reduced braking of the thread and consequently with less breaks. Also the vibrations characteristic of the thread upon its exchange, are reduced, thereby improving even further the operation. On the other hand, it should also be said that it is the actual aforedescribed arrangement of the weft thread in the grasping area which allows the construction of compact and light grippers, which are well balanced as to the distribution of the masses and which make it hence possible—as confirmed by practical experience—to obtain weft insertion speeds which are clearly higher than those obtained with the traditional systems, though keeping the mechanical stresses within reasonable limits.

The reduced dimensions and the specific shape of the grippers, as described, allow one to eliminate in the carrying gripper according to the invention the normal profile protecting the warp yarns, with remarkable advantages and, that is, extreme easiness of insertion, and consequent reduction of the weft stresses and of the brakings required in order to overcome the inertia of the thread, as well as the facilitated drawing out of the weft thread from the carrying gripper upon thread exchange, due to the absence of the slippage and consequent frictions which normally take place on the thread guard. The easiness of the weft disinsertion is also improved by the considerable simplicity and freedom of the weft thread guiding elements on the carrying gripper.

Finally, it should be noted that the appendix provided on the drawing gripper to protect the hook, favours the grasping of the weft by the appropriate members of such gripper, in that it opposes the possible "ballon" of the weft thread resulting from the deceleration of the grippers movement upon thread exchange, thus allowing one to reduce the braking power for the weft thread to be inserted.

I claim:

1. A pair of carrying grippers comprising weft thread grasping and holding members mounted on head parts of the grippers, said grasping and holding members being disposed entirely on opposite sides of a sliding plane, along which said head parts move only side by side, cooperating between them for exchanging a weft thread, one of said grippers comprising a pair of pegs for positioning the end of the weft thread, said pegs being arranged close to the free end of the thread grasping and holding means of said one gripper, on opposite sides thereof, and in a position such as to cause the weft thread to be positioned between said guide and the first of said pegs only slightly inclined in respect of the sliding plane, said one gripper comprising a basic gripper body, the rear part of which is fixed to a gripper advancement strap, and the head part of which is equipped with said weft thread grasping and holding means, and a unitary cover on said basic body and having a head part with an opening for housing said weft thread grasping and holding means, said pegs projecting from said cover and fitting into said basic body or vice versa, said cover having a rear part whose side close to the sliding plane projects beyond said plane in respect of the head part of the gripper, so as to form a guide for the weft thread in the form of a groove parallel to the plane itself.

* * * * *